United States Patent [19]

Geke et al.

[11] Patent Number: 4,814,108

[45] Date of Patent: Mar. 21, 1989

[54] CATIONIC SURFACTANTS BASED ON QUATERNARY AMMONIUM COMPOUNDS AND USE THEREOF IN CLEANING AGENTS

[75] Inventors: Juergen Geke, Duesseldorf; Horst Rutzen, Langenfeld, both of Fed. Rep. of Germany

[73] Assignee: Henkel Kommanditgesellschaft auf Aktien, Duesseldorf, Fed. Rep. of Germany

[21] Appl. No.: 62,536

[22] Filed: Jun. 12, 1987

[30] Foreign Application Priority Data

Jun. 13, 1986 [DE] Fed. Rep. of Germany ..... 3620011

[51] Int. Cl.[4] ..... C11D 1/62

[52] U.S. Cl. ..... 252/545; 252/528; 252/547; 564/285; 260/501.15

[58] Field of Search ..... 252/547, 548, 549, 358, 252/528; 564/285; 260/501.15

[56] References Cited

U.S. PATENT DOCUMENTS

| | | | |
|---|---|---|---|
| 3,503,890 | 3/1970 | Davisson et al. | 252/152 |
| 3,636,114 | 7/1987 | Tobler et al. | 260/567.6 |
| 4,040,992 | 8/1977 | Bechara et al. | 260/2.5 AC |
| 4,284,434 | 8/1981 | Lingmann et al. | 134/2 |
| 4,421,932 | 12/1983 | Rutzen et al. | 564/292 |
| 4,443,363 | 4/1984 | Klinger et al. | 252/547 |
| 4,678,605 | 7/1987 | Geke et al. | 252/547 |

FOREIGN PATENT DOCUMENTS

| | | |
|---|---|---|
| 0075065 | 3/1983 | European Pat. Off. . |
| 0127131 | 12/1984 | European Pat. Off. . |
| 0189085 | 7/1986 | European Pat. Off. . |
| 3247431 | 6/1984 | Fed. Rep. of Germany . |
| 3321608 | 12/1984 | Fed. Rep. of Germany . |
| 2319421 | 7/1976 | France . |

*Primary Examiner*—Prince E. Willis
*Assistant Examiner*—John F. McNally
*Attorney, Agent, or Firm*—Ernest G. Szoke; Wayne C. Jaeschke; Real J. Grandmaison

[57] ABSTRACT

The invention relates to new cationic surfactants based on quaternary ammonium compounds which are characterized by the general formula $$R^1\text{—CHOH—CHR}^2\text{—}\overset{+}{N}R^3R^4R^5\ X^- \qquad \text{(I)}$$

wherein $R^1$ may be a linear or branched alkyl residue having from 1 to 22 carbon atoms;

$R^2$ may be hydrogen or a linear or branched alkyl residue having from 1 to 21 carbon atoms, the total number of carbon atoms of the substituents $R^1$ and $R^2$ being in the range of from 8 to 22;

$R^3$ and $R^4$ represent methyl, ethyl, 2-hydroxyethyl or 2-hydroxypropyl;

$R^5$ represents an alkyl residue having from 4 to 6 carbon atoms or a phenalkyl residue having from 1 to 3 carbon atoms in the alkyl residue; and $X^-$ represents the anion of benzoic acid, of benzoic acid monosubstituted with $CH_3$, $NH_3$, $NO_2$, COOH, OH or $SO_3H$, of an aliphatic dicarboxylic acid having the general formula $HOOC\text{—}(CH_2)_n\text{—}COOH$ wherein n is a number from 2 to 8, of fumaric acid, of maleic acid or of sulfosuccinic acid;

and the use of such cationic surfactants in industrial cleaning agents.

11 Claims, No Drawings

NEW CATIONIC SURFACTANTS BASED ON QUATERNARY AMMONIUM COMPOUNDS AND USE THEREOF IN CLEANING AGENTS

BACKGROUND OF THE INVENTION

1. Field of the Invention

The invention relates to novel improved cationic surfactants based on quaternary ammonium compounds and the use of such cationic surfactants in industrial cleaner solutions.

2. Discussion of Related Art

For cleaning semi-finished products or finished products in industrial production, for example, automotive parts made of iron or steel, there are used aqueous solutions which contain tensides in addition to further auxiliary materials such as builder substances, complexing agents, organic or inorganic anticorrosive agents and optionally further substances. Thus, processes have been proposed in German Patent Application Nos. 27 12 900 and 32 47 431 wherein quaternary ammonium compounds are used in the alkaline pH range as cationic surfactants besides further cleaner components in which organic residues, more specifically alkyl residues of varying chain lengths, have been bonded to the ammonium nitrogen atom.

Counter-ions of the used ammonium cations include, for example, anions such as chloride, sulfate or methylsulfate which are known as anions that cause corrosion to occur. The necessary content of such anions undesirably promotes the corrosion of equipment parts and treated metal surfaces. This is an extraordinary disadvantage, more specifically in the treatment of metal surfaces with aqueous products, and particularly when the use of higher concentrations of cationics is desired. In fact, corrosion occurs not only over extended periods of time during intermediate storage of treated parts, but also immediately upon treatment of the respective surfaces with the aqueous application solutions.

In German Patent Application No. 30 48 642 there have also been disclosed tenside mixtures for cleaning bottles and other articles having hard surfaces, for example porcelain, china, synthetics, and metal wherein the mixtures contain cationic tensides based on ammonium compounds. However, it is also one disadvantage of these tensides that they contain chloride, bromide or methylsulfate as anions. In this case also, the anions adversely affect the corrosion resistance of parts of the apparatus such as dishwashers and of the treated surfaces as a consequence of the treatment.

Processes for preparing quaternary ammonium compounds which contain at least one long-chain hydroxyalkyl residue by reacting the salt of a tertiary amine and an organic acid in water with a terminal epoxide compound introducing a hydroxyalkyl residue at normal pressure, at a temperature between 40° C. and 100° C. and a pH value of at least 7 are known from German Patent Application No. 33 21 608. However, the resulting quaternary ammonium compounds are also not usable to meet the high requirements set for commercial cationic surfactants with respect to practical servicability and anticorrosive properties. Thus, the anions of numerous organic acids are not suitable as the counterions of cationic surfactants, since the resulting quaternary ammonium compounds are poorly soluble in water. Following their preparation, they are obtained in pasty form and, due to their poor solubility in water, cannot be blended in industrial cleansers. It has also been shown that ammonium cations containing numerous hydroxyalkyl groups cause interfering precipitations to occur in water which has not been fully deionized, which fact also renders the use of such cationics impossible. Furthermore, cationic surfactants are often expected to provide a demulsifying and/or defoaming action to emulsions and/or anionic surfactants or emulsifiers, respectively. However, the quaternary ammonium compounds disclosed in said afore-mentioned application have not shown any demulsifying action with respect to emulsions and/or anionic emulsifiers. These disadvantages have also not been compensated for by distinctly improved anticorrosive properties of the produced cationics, as only approximately the same corrosion resistance was obtained as compared with commercially available cationic tensides.

Thus, it is an object of the present invention to provide new improved cationic surfactants based on quaternary ammonium compounds which do not have the disadvantages of the prior art. More specifically, it is an object of this invention to provide cationic tensides useful for industrially applicable cleaning agents the components of which inhibit corrosion, cause a sufficient demulsifying effect to be accomplished with respect to anionic contamination, can be well blended in aqueous industrial cleaners, i.e. are readily water-soluble, do not cause the occurrence of any interfering precipitations, and are compatible with the components conventionally used in industrial cleaners.

DESCRIPTION OF THE INVENTION

Other than in the operating examples, or where otherwise indicated, all numbers expressing quantities of ingrdients or reaction conditions used herein are to be understood as modified in all instances by the term "about".

The above-mentioned objects are attained by providing new improved cationic tensides based on quaternary ammonium compounds wherein the ammonium nitrogen atom contains at last two alkyl radicals, one 2-hydroxyalkyl radical originating from the reaction with a terminal epoxide having from 10 to 24 carbon atoms and, optionally, one arylalkyl group and the anion of which is the anion of an organic carboxylic acid selected from the group consisting of benzoic acid, monosubstituted benzoic acid, aliphatic dicarboxylic acid, fumaric acid, maleic acid, and sulfosuccinic acid. It has surprisingly been found that such cationic tensides not only have good demulsifying properties relative to anionic tensides or emulsifiers, respectively, but also when present in industrial cleaners render the treated surfaces hydrophobic and thereby contribute to prevent corrosion by allowing the application liquids to run off smoothly and without drip from the treated surfaces and even create an antistatic effect on surfaces of synthetics.

Accordingly, the present invention provides new improved cationic tensides based on quaternary ammonium compounds which are characterized by the general formula $$R^1\text{—CHOH—CHR}^2\text{—}\overset{+}{N}R^3R^4R^5\ X^- \qquad \text{(I)}$$

wherein $R^1$ may be a linear or branched alkyl residue having from 1 to 22 carbon atoms;

$R^2$ may be hydrogen or a linear or branched alkyl residue having from 1 to 21 carbon atoms, the total number of carbon atoms of the substituents $R^1$ and $R^2$ being in the range of from 8 to 22;

$R^3$ and $R^4$ represent methyl, ethyl, 2-hydroxyethyl or 2-hydroxypropyl;

$R^5$ represents an alkyl residue having from 4 to 6 carbon atoms or a phenalkyl residue having from 1 to 3 carbon atoms in the alkyl residue; and $X^-$ represents the anion of benzoic acid, of benzoic acid monosubstituted with $CH_3$, $NH_3$, $NO_2$, COOH, OH or $SO_3H$, of an aliphatic dicarboxylic acid having the general formula HOOC—$(CH_2)_n$—COOH wherein n is a number from 2 to 8, of fumaric acid, of maleic acid or of sulfosuccinic acid.

Examples of the linear or branched alkyl residue as represented by $R^1$ and $R^2$ include methyl, ethyl, propyl, isopropyl, n-butyl, tert-butyl, pentyl, hexyl, heptyl, octyl, nonyl, decyl, dodecyl, tetradecyl and hexadecyl. Preferred are those quaternary ammonium compounds wherein $R^2$ is hydrogen and $R^1$ is a linear or branched alkyl residue having from 8 to 22 carbon atoms, e.g. n-octyl, n-decyl, n-dodecyl, n-tetradecyl or n-hexadecyl. In any event, the total number of carbon atoms of the two substituents $R^1$ and $R^2$ must be in the range from 8 to 22 carbon atoms.

The residue $R^5$ bonded to the ammonium nitrogen atom represents alkyl residues such as, for example, n-butyl, i-butyl, tert-butyl, n-pentyl, tert-butyl-methyl, n-hexyl, or phenalkyl residues such as benzyl, phenylethyl or phenylpropyl.

The corresponding anion in the cationic surfactants according to the invention is the anion of an organic carboxylic acid, i.e. the residue $X^-$ in general formula I represents the anion of benzoic acid, of benzoic acid monosubstituted with $CH_3$, $NH_3$, COOH, OH or $SO_3H$, of an aliphatic dicarboxylic acid having the general formula HOOC—$(CH_2)_n$—COOH wherein n is from 2 to 8, i.e. of succinic acid, of glutaric acid, of adipic acid, of pimelic acid, of suberic acid, of azelaic acid, of sebacic acid, of fumaric acid, of maleic acid or of sulfosuccinic acid. Particularly preferred are the anions of benzoic acid and of fumaric acid.

Depending on the valency of the anion, i.e., the basicity of the respective organic carboxylic acid, the cation of general formula (I) may be contained several times in the quaternary ammonium compounds according to the invention. Thus, general formula (I) includes the neutral as well as the respective acidic salts.

In industrial cleaning agents, it is preferred to use the following individual compounds, namely, benzyldimethyl-2-hydroxydodecylammonium benzoate, and bis-(benzyldimethyl-2-hydroxydodecylammonium)-fumarate. Of these, benzyldimethyl-2-hydroxydodecylammonium benzoate is particularly preferred.

The compounds having the structure of general formula (I) according to the present invention can be prepared by per se known methods by reacting the salt of a tertiary amine having the general formula $$NR^3R^4R^5 \qquad (II)$$

wherein $R^3$, $R^4$ and $R^5$ are as defined above, and of an organic acid having the general formula $$X^-H^+ \qquad (III)$$

wherein $X^-$ is as defined above, in water with an epoxide compound having the general formula

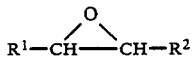

(IV)

wherein $R^1$ and $R^2$ are as defined above and taken together have a total number of 8 to 22 carbon atoms in a stoichiometric ratio at normal pressure and at a temperature between 40° C. and 100° C., the reaction mixture having a pH of at least 7 before the reaction begins.

The epoxides of general formula (IV) used for the preparation of the quaternary ammonium compounds according to the invention may be epoxides having from 10 to 24 carbon atoms, wherein the oxirane ring may be in any position of the molecule. However, those quaternary ammonium compounds prepared by reaction of the amine salt with an 1,2-epoxide, i.e. the compounds having general formula (I) wherein $R^1$ is an alkyl residue having from 8 to 22 carbon atoms and $R^2$ is a hydrogen atom are preferred.

The amines used for the preparation of the quaternary ammonium compounds of general formula (I) preferably are tertiary alkyl-, hydroxyalkyl- or alkyl-arylamines; dimethylbutylamine and dimethylbenzylamine being particularly preferred.

The quaternary ammonium compounds according to the invention are used as cationic surfactants in industrial cleaner solutions. In said use, they have the advantage over other cationics such as quaternary ammonium compounds already known from the prior art that they do not contain any counter-anions which are corrosive or cause undesirable precipitations to occur. In contrast thereto, the anions of the organic acid employed in the preparation of the ammonium compounds according to the invention are even capable of inhibiting the corrosion process on cleaned metal surfaces. Thus, due to the absence of an accumulation of corrosive anions in the bath and the inhibiting effect of the carboxylic acid anions, an improvement of the anticorrosive properties in aqueous media is accomplished. This is applicable to parts which have to be subjected to an intermediate storage period prior to further processing as well as to parts which are immediately subjected to further processing. The improved corrosion resistance will be apparent in those parts, having been treated with industrial cleaners containing quaternary ammonium compounds, which due to their geometrical shape act like a ladle. In the case of use of conventional cleaners the danger of corrosion occurring on such parts was particularly high, since upon vaporization of the solvent, usually water, a high accumulation of the ingredients and, hence, of the corrosive components as well, was to be feared. This is prevented by the use of industrial cleaner solutions containing the quaternary ammonium compounds according to the invention as cationic tensides.

As the cationic tensides according to the invention are readily water-soluble, they are easily blendable and do not gel in the use solution. Corresponding use solutions also show a favorable run-off property.

The cationic tensides according to the invention provide another advantage in that a beneficial hydrophobization of the purified surfaces, more particularly of purified metal surfaces, is observed. Furthermore, corrosion of the treated articles is prevented by a good run-off property of the use solution.

It has further been observed that aqueous solutions of industrial cleaners which contain the quaternary ammonium compounds according to the invention as cationics, can also be beneficially used for cleaning synthetic materials since they provide an antistatic effect. It is just this property which opens a wide field of future applications to such products, since surfaces of synthetic materials increasingly tend to be cleaned by spray processes.

The quaternary ammonium compounds according to the present invention are suitable for use in all cleaners that are important for industrial cleaning operations. Thus, they can be included in sprayable cleaners, e.g. neutral to weakly alkaline cleaners or acidic cleaners, more specifically in such cleaner solutions which are sprayed under high pressure onto the articles to be cleaned. However, in the same manner they may be advantageously used in immersion cleaners based on nonionic surfactants.

The quaternary ammonium compounds according to the present invention may also be used as cationic tensides to act as demulsifiers or anti-foaming agents in industrial cleaner solutions for spray cleaning or immersion cleaning.

The new improved cationic surfactants based on quaternary ammonium compounds may be blended with further conventional components for industrial cleaner solutions in accordance with per se known procedures. In addition to the quaternary ammonium compounds and further conventional ingredients, said solutions may optionally contain further additives, e.g. alkanolamines, phosphates, borates or nitrites. If desired, inhibitors, more specifically those for nonferrous metals, or biocides such as, for example, hexahydrotriazine derivatives and/or phenols and/or chlorophenols, may be added to the solutions in order to inhibit the occurrence of bacteria and/or fungi in the spraying or immersing equipment.

The present invention is further illustrated by means of the following examples.

EXAMPLE I

This example describes the preparation of benzyl-2-hydroxydodecyldimethyl ammonium benzoate.

A three-necked flask equipped with stirrer, contact temperature control, and reflux condenser was charged, in sequence, with 106.7 g of water,
135.2 g (1.0 mol) of dimethylbenzylamine,
97.7 g (0.8 mol) benzoic acid, and
188.0 g (1.0 mol) of 1,2-epoxydodecane (EpOV 8.551, therefrom calculated MW 188.0)

while stirring, and the mixture was heated to 95° C.

After a few minutes a clear solution has been formed to which after 15 minutes the residual amount of 24.4 g (0.2 mol) of benzoic acid was added; and the mixture was stirred at 95° C. for 6 hours. The solution was about 80% solids and had the following characteristic values:

| AcV (acid value) | EpOV (epoxide value) | AV (amine value) | Epton value | Barr value |
|---|---|---|---|---|
| 3.6 | 0.002 | 104.1 | 132.2 mval/100 g | 128 mval/100 g |

EXAMPLE II

This example describes the preparation of Bis-(benzyl-2-hydroxydodecyl-di-methyl-ammonium)-fumarate.

In a stirrer-equipped apparatus consisting of a three-necked flask, contact temperature control and reflux condenser 81.25 g (0.7 mol) of fumaric acid were dissolved in 126.98 g of water and,
184.30 g (1.4 mol) of dimethylbenzylamine, and then
263.20 g (1.4 mol) of 1,2-epoxydodecane were added.

With continuous stirring the mixture was heated at 95° C. and maintained at this temperature for 4.5 hours.

The resulting yellowish about 80% solids solution was viscous upon cooling and had the following characteristic values:

| AcV (acid value) | EpOV (epoxide value) | AV (amine value) | Epton value | Barr value |
|---|---|---|---|---|
| 14.4 | 0.07 | 112 | 138 mval/100 g | 112 mval/100 g |

EXAMPLE III

This example describes the preparation of Benzyl-dimethyl-2-hydroxydodecyl-ammoniumsuccinate.

The apparatus described in Example II was charged, in this sequence, with 109.4 g of water, 135.2 g (1.0 mol) of dimethylbenzylamine, 118.1 g (1.0 mol) of succinic acid (acid value 950.2) and 190.9 g (1.0 mol) of 1,2-epoxydodecane (EpOV 8.38, therefrom calc, MW 190.0). After stirring for 4.5 hours at 95° C. a solution having a single phase had been formed. Upon cooling the product became turbid; had an epoxide value of 0.10; and an acid value of 118.6.

EXAMPLE IV

This example describes the preparation of n-butyl-dimethyl-2-hydroxydodecylammoniummaleate.

In the same apparatus and under the same conditions as in Example II the following reactants were reacted: 93.8 g of water, 101.2 g (1.0 mol) of dimethylbutylamine, 116.1 g (1.0 mol) of maleic acid (acid value 966.8) and 190.0 g (1.0 mol) of 1,2-epoxy-dodecane (EpOV 8.38). A yellow 80% solids solution of the product was formed which solution was clear when hot and turbid after cooling; had an epoxide value of 0.01; an acid value of 118.8; and an Epton value of 125.1 mval/100 g.

EXAMPLE V

Thie example describes the preparation of Benzyl-dimethyl-2-hydroxyhexadecylammonium-sulfosuccinate.

In the same apparatus and under the same conditions as in Example II the following reactants were reacted: 68.1 g of water, 67.6 g (0.5 mol) of dimethylbenzylamine, 99.1 g (0.5 mol) of sulfosuccinic acid (acid value 849.5) and 123.8 g (0.5 mol) of 1,2-epoxyhexadecane (epoxide value 6.46). Upon cooling to room temperature the yellow solution which was clear when hot solidified to form a semi-solid mass containing the product in a concentration of 81%; had an epoxide value of 0.06; an acid value of 161.3; and an Epton value of 132.7 mval/100 g.

EXAMPLE VI

Cleaner solutions intended for use as cleaners to be applied by spraying and having concentrations of use in the range of from 0.5 to 5% were prepared. The compositions of these cleaner solutions were as follows (the percent is % by weight):

(a) Neutral Cleaners

Composition I

30% of triethanolamine;
10% of caprylic acid;
5% of hexahydrotriazine derivative;
0.5% of tolyl triazole;
4% of an addition product of 2 moles ethylene oxide (EO) and 4 moles propylene oxide (PO) to an alcohol having 18 carbon atoms;
1% of an addition product of 5 moles EO and 30 moles PO to 1,2-propylene glycol;
1.5% of benzyldimethyl-2-hydroxydodecylammonium benzoate; and
48.0% of fully deionized water.

Composition II

10% of sodium caprylate;
10% of triethanolamine;
5% of borax
10% of sodium triphosphate
4% of an addition product of 9 moles EO and 10 moles PO to nonylphenol;
2% of bis(benzyldimethyl-2-hydroxydodecylammonium)fumarate; and
59.0% of fully deionized water.

(b) Alkaline Industrial Cleaner

15% of potassium triphosphate;
6% of triethanolamine;
5% of potassium hydroxide;
2% of an addition product of 3 moles EO and 6 moles PO to an alcohol having 12 to 18 carbon atoms;
4% of isononaoic acid;
2% of bis(benzyldimethyl-2-hydroxydodecylammonium)succinate; and
66% of fully deionized water.

(c) Acidic Cleaners

Composition 1

25% of sodium dihydrogenphosphate;
1% of benzoic acid;
0.2% of sodium molybdate;
1% of butyldimethyl-2-hydroxydodecylammonium benzoate;
3% of the nonionic tenside Triton DF16®; and
69.8% of fully deionized water.

Composition 2

12% of diethanolamine;
15% of 2-phosphonobutane-1,2,4-tricarboxylic acid;
5% of gluconic acid;
3% of the nonionic tenside Triton DF16®;
8% of fatty alcohol sulfate in the form of the sodium salt;
3% of phosphoric acid;
2% of bis(benzyldimethyl-2-hydroxydodecylammonium)fumarate; and
52% of fully deionized water.

The cleaning agents formulated as described above were well aaplicable by spraying. They only showed low tendency, or no tendency at all, to foaming. The cleaning baths were stable over an extended period of time and did not lose any cleaning power during that period. Due to the use of the quaternary ammonium compounds according to the present invention, the metal surfaces treated by being sprayed with the cleaners did not corrode, but had an increased corrosion resistance as compared to surfaces treated with conventional cleaners.

EXAMPLE VII

This example describes the preparation and use of alkaline industrial immersion cleaners; concentration of application in the range of from 1 to 7%.

Composition 1

15% of potassium triphosphate;
6% of triethanolamine;
6% of isononaoic acid;
1.5% of benzyldimethyl-2-hydroxyhexadecylammonium benzoate;
10% of diethanolamine;
5% of an addition product of 10 moles EO to nonylphenol, and
56.5% fully deionized water.

Composition 2

40% of sodium diphosphate;
30% of sodium orthophosphate;
10% of sodium triphosphate;
10% of sodium metasilicate;
1% of bis(benzyldimethyl-2-hydroxydodecylammonium)fumarate; and
9% of an addition product of 10 moles EO to nonylphenol.

The cleaning agents formulated as described above had a high cleaning power on treated metal surfaces over an extended period of time, and their baths had a high stability. Metal surfaces subjected to an immersion treatment using the above-described cleaners had an increased corrosion resistance as compared to surfaces treated with conventional cleaners.

EXAMPLE VIII

This example illustrates the demulsifying effect of various cleaner compositions.

A. Neutral Cleaner

Described is the demulsifying activity of a neutral cleaner having the composition as follows:

35% of alkanolamine $C_8$–$C_{12}$-carboxylate;
2% of 1-hydroxyethane-1,1-diphosphonic acid;
0.5% of mercaptobenzthiazole;
3% of a block polymer of ethylenediamine with 30 moles of ethylene oxide and 60 moles of propylene oxide;
1% of an addition product of 10 moles of ethylene oxide to a $C_{12}$–$C_{16}$-fatty amine; and
58.5% of water.

a. Segregation of an Emulsion

The ability of segregating an emulsion was determined according to the following test:

10 g of drilling oil were emulsified with 40 g of a 2% aqueous neutral cleaner solution in a 270 ml oil-separating flask at room temperature. An equivalent amount of BDHA benzoate (BDHA=benzyl dimethyl-2-hydroxydodecylammoniumion) was added. The flask was filled up while shaken by adding a hot 2% neutral cleaner solution. Demulgation spontaneously began to take place. The liquid mixture was maintained at a temperature of 80° C. for 2 hours to effect complete separation of the oil from the "emulsion-like phase". It was found the the oil was substantially quantitatively separated.

b. Addition of an Anti-Foaming Agent 10 g of drilling oil were emulsified with 40 g of a 2% aqueous neutral cleaner solution in a 270 ml oil-separating flask at room temperature. BDHA benzoate was added to this emulsion in an excess over the stoichiometric amount (ratio of demulsifier to anionic emulsifier to be 1.2:1). There was further added the addition product of 30 moles of ethylene oxide and 60 moles of propylene oxide to ethylene diamine as an anti-foaming agent (ratio of demulsifier to anti-foaming agent to be 1:1) The flask was filled up while shaken by adding a hot 2% neutral cleaner solution. Separation spontaneously began to take place. The recycled cleaner solution could be sprayed without foam-formation.

B. Alkaline Cleaners

Illustrated in the following is the demulgation in the presence of alkaline cleaners having the compositions as set forth hereinbelow:

Composition a

63% of sodium metasilicate;
14% of sodium hydroxide;
15% of soda;
2% of fatty alcohol containing 14 moles of ethylene oxide; and;
3% of alkylbenzenesulfonate.

A 4% cleaner solution in tap water was emulsified at room temperature with a 2% drilling oil concentrate. Then more than an equivalent amount (1:1.1) of BDHA benzoate was added, and the mixture was well stirred for about 3 minutes. Then the mixture was allowed to sit. Separation of the oil began immediately.

Composition b

60% of sodium metasilicate;
10% of sodium hydroxide;
15% of soda;
10% of sodium diphosphate;
2.5% of fatty alcohol containing 14 of moles ethylene oxide; and
2.5% of cocoamine containing 12 moles of ethylene oxide.

To a 3% cleaner solution loaded as described under composition a, double the equivalent amount of BDHA benzoate was added to effect the segregation of the emulsion. Separation of the oil began immediately, the aqueous phase being nearly clear.

Composition c

50% of sodium diphosphate;
15% of sodium triphosphate;
15% of trisodium phosphate;
10% of soda;
7.7% of nonylphenol containing 14 moles of ethylene oxide; and
2.3% of coconut fatty acid monoethanolamide containing 4 moles of ethylene oxide.

To a 2% clear solution loaded as described under compositions a and b, double the equivalent amount of BDHA benzoate was added. Separation of the oil began spontaneously, the aqueous phase becoming nearly clear.

The presence of pyro-or polyphosphates and/or anionic tensides required the addition of a higher amount of demulsifier to effect a complete and rapid demulsification.

EXAMPLE IX

This example illustrates the use of general cleaners, e.g. cleaners for cars, cleaners for walls and floors of industrial plants and products for use in steam jet cleaning; application concentration in the range of from 2 to 30%.

Composition 1

8% of an addition product of 14 moles of EO to an alcohol having 12 to 14 carbon atoms;
7% of a fatty alcohol sulfate;
3% of butyldimethyl-2-hydroxydodecylammonium benzoate;
5% of potassium hydroxide;
10% of diethanolamine;
6% of phosphoric acid and
61% of fully deionized water.

Composition 2

8% of sodium triphosphate;
5% of isononaic acid;
5% of boric acid;
8% of monoethanolamine;
1% of potassium hydroxide;
5% of an addition product of 12 moles of EO to an amine having 12 carbon atoms;
3% of bis(benzyldimethyl-2-hydroxydodecylammonium)fumarate; and
65% of fully deionized water.

The cleaning agents having the above-described compositions showed good cleaning effects and at the same time a uniform sag-free run-off behavior on the treated surfaces.

Due to the use of the quaternary ammonium compounds according to the invention, the corrosion resistance of metal surfaces and articles treated with the cleaner solutions was significantly improved over that of metal surfaces and articles treated with conventional cleaners.

EXAMPLE X

This example illustrates a comparative corrosion test.

In the following test, the corrosion-inhibiting properties of two solutions were tested by comparison, one of which contained Dehyquart ®LDB (Henkel) as a quaternary ammonium compound known from the prior art, and the other one contained BDHA benzoate as the quaternary ammonium compound according to the present invention.

The test was carried out in accordance with the chips test of DIN 51360/2 using solutions having concentrations of from 1% to 3% in fully deionized (f.d.) and 20°d-water of concentrates of the formulations I and II as follows:

Formulation I 12.5% of Dehyquart ®LDB (content of active ingredient: 35%);
37.5% of diethanolamine; and
remainder, water.

Formulation II 5.5% of BDHA benzoate (content of active inghredient; 80%);
37.5% of diethanolamine; and remainder, water.

The results are summarized in the following Table.

| Concentration of solution | Degree of Corrosion according to DIN 51360/2 using: Formulation I f.d. water | Formulation I 20° d-water | Formulation II f.d. water | Formulation II 20° d-water |
|---|---|---|---|---|
| 1% | 2 | 4 | 0.5 | 3 |
| 2% | 0 | 3 | 0 | 2 |
| 3% | 0 | 2 | 0 | 0.5 |

From columns 4 and 5, it will be apparent that Formulation II (BDHA benzoate) provides a significantly improved anticorrosive property.

We claim:

1. A cleaning composition for hard surfaces comprising at least one nonionic surfactant, a diluent, and a cationic quaternary ammonium compound in at least an amount effective to de-emulsify with respect to anionic contamination, impart an anticorrosive effect, impart a defoaming effect, impart hydrophobic properties to a cleaned surface, impart antistatic properties to a cleaned surface, or a combination thereof, said compound having the formula:

$$R^1—CHOH—CHR^2—\overset{+}{N}R^3R^4R^5\ X^- \quad (I)$$

wherein $R^1$ may be a linear or branched alkyl residue having from 1 to 22 carbon atoms;

$R^2$ may be hydrogen or a linear or branched alkyl residue having from 1 to 21 carbon atoms, the total number of carbon atoms of the substituents $R^1$ and $R^2$ being in the range of from 8 to 22;

$R^3$ and $R^4$ represent methyl, ethyl, 2-hydroxyethyl or 2-hydroxypropyl;

$R^5$ represents an alkyl residue having from 4 to 6 carbon atoms or a phenalkyl residue having from 1 to 3 carbon atoms in the alkyl residue; and $X^-$ represents the anion of benzoic acid, of benzoic acid monosubstituted with $CH_3$, $NH_3$, $NO_2$, COOH, OH or $SO_3H$, of an aliphatic dicarboxylic acid having the general formula $HOOC—(CH_2)_n—COOH$ wherein n is a number from 2 to 8, of fumaric acid, of maleic acid or of sulfosuccinic acid.

2. A cleaning composition according to claim 1, wherein in general formula (I), $R^1$ is an alkyl residue having from 8 to 22 carbon atoms, and $R^2$ is a hydrogen atom.

3. A cleaning composition according to claim 2, wherein in general formula (I), $R^1$ is a decyl or tetradecyl residue.

4. A cleaning composition according to claim 1, wherein in general formula (I), $R^3$ and $R^4$ represent methyl groups.

5. A cleaning composition according to claim 1, wherein in general formula (I), $R^5$ represents a benzyl, or n-butyl residue.

6. A cleaning composition according to claim 1, wherein in general formula (I), $X^-$ represents the anion of benzoic acid.

7. A cleaning composition according to claim 1, wherein in general formula (I), $X^-$ represents the anion of fumaric acid.

8. A cleaning composition according to claim 1 wherein said compound comprises benzyldimethyl-2-hydroxydodecylammonium benzoate.

9. A cleaning composition according to claim 1 wherein said compound comprises bis(benzyldimethyl-2-hydroxydodecylammonium)fumarate.

10. A cleaning composition according to claim 1 comprising a spray-cleaning solution.

11. A cleaning composition according to claim 1 comprising an immersion cleaning solution.

* * * * *